US006830860B2

(12) United States Patent
Sacripante et al.

(10) Patent No.: US 6,830,860 B2
(45) Date of Patent: Dec. 14, 2004

(54) TONER COMPOSITIONS AND PROCESSES THEREOF

(75) Inventors: Guerino G. Sacripante, Oakville (CA); Hadi K. Mahabadi, Toronto (CA); Fatima M. Mayer, Mississauga (CA); Edward G. Zwartz, Mississauga (CA); T. Brian McAneney, Burlington (CA)

(73) Assignee: Xerox Corporation, Stamford, CT (US)

( * ) Notice: Subject to any disclaimer, the term of this patent is extended or adjusted under 35 U.S.C. 154(b) by 61 days.

(21) Appl. No.: 10/349,548

(22) Filed: Jan. 22, 2003

(65) Prior Publication Data

US 2004/0142266 A1 Jul. 22, 2004

(51) Int. Cl.[7] ..... G03G 9/087
(52) U.S. Cl. ..... 430/109.3; 430/109.4
(58) Field of Search ..... 430/109.3, 109.4

(56) References Cited

U.S. PATENT DOCUMENTS

| | | | | |
|---|---|---|---|---|
| 3,967,962 A | * | 7/1976 | O'Malley | 430/109.4 |
| 4,254,207 A | | 3/1981 | Landoll et al. | 430/137 |
| 4,385,107 A | | 5/1983 | Tanaka et al. | 430/98 |
| 4,543,313 A | | 9/1985 | Mahabadi et al. | 430/109 |
| 4,891,293 A | | 1/1990 | Sacripante et al. | 430/109 |
| 4,952,477 A | | 8/1990 | Fuller et al. | 430/109 |
| 4,973,539 A | | 11/1990 | Sacripante et al. | 430/109 |
| 4,990,424 A | | 2/1991 | Van Dusen et al. | 430/106.6 |
| 5,057,392 A | | 10/1991 | McCabe et al. | 430/109 |
| 5,147,747 A | | 9/1992 | Wilson | 430/109 |
| 5,166,026 A | | 11/1992 | Fuller et al. | 430/106 |
| 5,278,020 A | | 1/1994 | Grushkin et al. | 430/137 |
| 5,290,654 A | | 3/1994 | Sacripante et al. | 430/137 |
| 5,308,734 A | | 5/1994 | Sacripante et al. | 430/137 |
| 5,858,601 A | | 1/1999 | Ong et al. | 430/137 |
| 5,863,698 A | | 1/1999 | Patel et al. | 430/137 |
| 5,925,488 A | | 7/1999 | Patel et al. | 430/137 |
| 5,977,210 A | | 11/1999 | Patel et al. | 523/161 |
| 6,017,671 A | | 1/2000 | Sacripante et al. | 430/110 |
| 6,383,705 B2 | | 5/2002 | Aoki et al. | 430/109.4 |
| 6,395,442 B1 | | 5/2002 | Hayashi et al. | 430/109.4 |
| 6,413,691 B2 | | 7/2002 | Daimon et al. | 430/109.4 |

FOREIGN PATENT DOCUMENTS

| | | |
|---|---|---|
| DE | 102 13 866 A1 | 10/2002 |
| EP | 0 254 543 | 1/1988 |
| EP | 1 126 324 | 8/2001 |
| EP | 1 341 049 | 9/2003 |

* cited by examiner

*Primary Examiner*—Mark A. Chapman

(57) ABSTRACT

A toner comprised of a branched amorphous resin, a crystalline resin, and a colorant.

37 Claims, No Drawings

TONER COMPOSITIONS AND PROCESSES THEREOF

BACKGROUND OF THE INVENTION

The present invention is generally directed to toner compositions and processes thereof, and more specifically, to toner compositions comprised of a mixture of a crystalline resin, a branched amorphous resin, a colorant and optionally a wax. More specifically, in embodiments of the present invention, there is disclosed a toner composition with a low fixing temperature of from about 90° C. to about 110° C., and which toner is comprised of a colorant, such as a pigment, a crystalline resin such as an alkali sulfonated polyester, and a branched amorphous resin such as a branched alkali sulfonated polyester resin. Also, in embodiments, the present invention is directed to a process for generating low fixing toners, and which process is comprised of coalescing a mixture of colorant dispersion, a crystalline polyester emulsion and a branched amorphous polyester emulsion, and optionally a wax emulsion with a coagulant, such as zinc acetate or magnesium chloride, at a temperature of from about 60° C. to about 85° C.; a process for preparation of low fixing toners comprised of melt mixing a crystalline sulfonated polyester resin and a branched amorphous sulfonated polyester resin, followed by emulsification in water of the resulting melt mixed resin, and then by the addition of a colorant dispersion, optionally a wax emulsion and a coagulant, such as zinc acetate or magnesium chloride, and heating at a temperature of from about 60° C. to about 85° C.; a process for generating low fixing toners, and which process is comprised of melt mixing or kneading a crystalline resin, a branched amorphous resin, a colorant and optionally a wax, followed by grinding, pulverizing the mixture to provide toner particles, and classification.

Crystalline and branched resins are known; for example, crystalline refers to a polymer with a 3 dimensional order, and branched refers to a polymer with chains linked to form a crosslinked network.

Xerographic toners of a resin, a pigment, and a charge control agent are known. Toners useful for xerographic applications should exhibit certain performances related to storage stability, and particle size integrity, that is, it is desired to have the particles remain intact and not agglomerate until they are fused on paper. Since environmental conditions vary, the toners also should not substantially agglomerate up to a temperature of from about 50° C. to about 55° C. The toner composite of resins and colorant should also display acceptable triboelectrification properties which vary with the type of carrier or developer composition. A valuable toner attribute is the relative humidity sensitivity ratio, that is, the ability of a toner to exhibit similar charging behavior at different environmental conditions such as high humidity or low humidity. Typically, the relative humidity of toners is considered as the ratio between the toner charge at 80 percent humidity divided by the toner charge at 20 percent humidity. Acceptable values for relative humidity sensitivity of toner vary, and are dependant on the xerographic engine and the environment. Typically, the relative humidity sensitivity ratio of toners is expected to be at least 0.5 and preferably 1.

Another important property for xerographic toner compositions is its fusing properties on paper. Due to energy conservation measures, and more stringent energy characteristics placed on xerographic engines, such as on xerographic fusers, there has been exerted pressure to reduce the fixing temperatures of toners onto paper, such as achieving fixing temperatures of from about 90° C. to about 110° C., to permit less power consumption and allowing the fuser system to possess extended lifetimes. For noncontact fuser, that is a fuser that provides heat to the toner image on paper by radiant heat, the fuser usually is not in contact with the paper and the image. For contact fuser, that is a fuser which is in contact with the paper and the image, the toner should not substantially transfer or offset onto the fuser roller, referred to as hot or cold offset depending on whether the temperature is below the fixing temperature of the paper (cold offset), or whether the toner offsets onto a fuser roller at a temperature above the fixing temperature of the toner (hot offset). Another desirable characteristic is sufficient release of the paper image from the fuser roll; for oil containing fuser rolls, the toner composites may not contain a wax, however, for fusers without oil on the fuser (usually hard rolls), the toner composites will usually contain a lubricant like a wax to provide release and stripping properties. Thus, a toner characteristic for contact fusing applications is that the fusing latitude, that is the temperature difference between the fixing temperature and the temperature at which the toner offsets onto the fuser, should be from about 30° C. to about 90° C., and preferably from about 50° C. to about 90° C. Additionally, depending on the xerographic applications, other toner characteristics may be desired, such as providing high gloss images, such as from about 60 to about 80 Gardner gloss units, especially in pictorial color applications. Other toner characteristics relate to nondocument offset, that is, the ability of paper images not to transfer onto adjacent paper images when stacked up, at a temperature of about 55° C. to about 60° C.; nonvinyl offset properties; high image projection efficiency when fused on transparencies, such as from about 75 to 100 percent projection efficiency and preferably from about 85 to 100 percent projection efficiency. The projection efficiency of toners can be directly related to the transparency of the resin utilized, and clear resins are desired.

Additionally, small sized toner particles, such as from about 3 to about 12 microns, and preferably from about 5 to about 7 microns, are desired, especially in xerographic engines wherein high resolution is a characteristic. Toners with the aforementioned small sizes can be economically prepared by chemical processes, also known as direct or "In Situ" toner process, and which process involves the direct conversion of emulsion sized particles to toner composites by aggregation and coalescence, or by suspension, microsuspension or microencapsulation processes.

REFERENCES

Toner composites are known, such as those disclosed in U.S. Pat. No. 4,543,313, the disclosure of which is totally incorporated herein by reference, and wherein there are illustrated toner compositions comprised of a thermotropic liquid crystalline resin with narrow melting temperature intervals, and wherein there is a sharp decrease in the melt viscosity above the melting point of the toner resin particles, thereby enabling matte finishes. The aforementioned toners of the '313 patent possess sharp melting points and can be designed for non-contact fusers such as Xenon flash lamp fusers generating 1.1 microsecond light pulses. For contact fusing applications, sharp melting materials can offset onto the fuser rolls, and thus the toners of the '313 patent may possess undesirable fusing latitude properties.

In U.S. Pat. No. 4,891,293, there are disclosed toner compositions with thermotropic liquid crystalline copolymers, and wherein sharp melting toners are illustrated. Moreover, in U.S. Pat. No. 4,973,539 there are disclosed toner compositions with crosslinked thermotropic liquid crystalline polymers with improved melting characteristics as compared, for example, to the thermotropic liquid crystalline resins of the '313 or '293 patents.

Furthermore, it is known that liquid crystalline resins may be opaque and not clear, and hence such toners are believed to result in poor projection efficiencies. The toners of the present invention in contrast are comprised of a crystalline resin with sharp melting characteristics, and a branched resin with a broad molecular weight, and wherein there are permitted fusing characteristics, such as lower fixing temperatures of from about 90° C. to about 110° C. and a broad fusing latitude of from about 50° C. to about 90° C., with contact fusers with or without oil. Furthermore, a crystalline portion of from about 5 to about 40 percent of the toner is believed to be dispersed in small domains within the amorphous and clear branched resin, and with domain diameter sizes of, for example, less than or equal to about 100 to about 2,000 nanometers, and more specifically, from about 100 to about 500 nanometers.

Low fixing toners comprised of semicrystalline resins are also known, such as those disclosed in U.S. Pat. No. 5,166,026, and wherein toners comprised of a semicrystalline copolymer resin, such as poly(alpha-olefin) copolymer resins, with a melting point of from about 30° C. to about 100° C., and containing functional groups comprising hydroxy, carboxy, amino, amido, ammonium or halo, and pigment particles, are disclosed. Similarly, in U.S. Pat. No. 4,952,477, toner compositions comprised of resin particles selected from the group consisting of a semicrystalline polyolefin and copolymers thereof with a melting point of from about 50° C. to about 100° C. and pigment particles are disclosed. Although, it is indicated that some of these toners may provide low fixing temperatures of about 200° F. to about 225° F. (degrees Fahrenheit) using contact fusing applications, the resins are derived from components with melting characteristics of about 30° C. to about 50° C., and which resins are not believed to exhibit more desirable melting characteristics, such as about 55° C. to about 60° C.

In U.S. Pat. No. 4,990,424 toners comprised of a blend of resin particles containing styrene polymers or polyesters, and components selected from the group consisting of a semicrystalline polyolefin and copolymers thereof with a melting point of from about 50° C. to about 100° C. are disclosed. Fusing temperatures of from about 250° F. to about 330° F. (degrees Fahrenheit) are reported.

Low fixing crystalline based toners are disclosed in U.S. Pat. No. 6,413,691, and wherein a toner comprised of a binder resin and a colorant, the binder resin containing a crystalline polyester containing a carboxylic acid of two or more valences having a sulfonic acid group as a monomer component, are illustrated. The crystalline resins of the '691 patent are believed to be opaque, resulting in low projection efficiency.

Crystalline based toners are disclosed in U.S. Pat. No. 4,254,207. Low fixing toners comprised of crosslinked crystalline resin and amorphous polyester resin are illustrated in U.S. Pat. No. 5,147,747 and U.S. Pat. No. 5,057,392, and wherein the toner powder is comprised, for example, of polymer particles of partially carboxylated crystalline polyester and partially carboxylated amorphous polyester that has been crosslinked together at elevated temperature with the aid of an epoxy novolac resin and a crosslinking catalyst.

Also of interest are U.S. Pat. Nos. 6,383,705 and 4,385,107, the disclosures of which are totally incorporated herein by reference.

SUMMARY

It is a feature of the present invention to provide toners comprised of a crystalline resin, a branched amorphous resin, a colorant and optionally a wax.

Moreover, it is a feature of this invention to provide a toner with low fixing temperatures, such as from about 90° C. to about 110° C.

It is another feature of the present invention to provide a toner with a broad fusing latitude, such as from about 50° C. to about 90° C.

In yet another feature of the present invention there is provided a toner which displays a glass transition of from about 55° C. to about 60° C. as measured by the known differential scanning calorimeter.

Moreover, it is a feature of the present invention to provide a toner with a high projection efficiency, such as from about 75 to about 99 percent transparency.

Furthermore, it is a feature of the present invention to provide a toner with substantially no image/toner document offset up to a temperature of from about 55° C. to about 60° C.

It is another feature of this invention to provide an economical process for the preparation of low fixing toner, such as an emulsion coalescence process.

In yet another feature of the present invention there is provided a toner which displays a blocking temperature of from about 45° C. to about 60° C., and which temperature can be measured as follows.

20 Grams of toner, from about 6 to about 11 microns in average diameter, are blended with about 2 to about 4 percent of surface additives, such as silica and/or titania, and sieve blended through a 106 $\mu$m screen. A 10 gram sample of the toner is placed into an aluminum weighing pan, and this sample is conditioned in a bench top environmental chamber at various temperatures (45° C., 50° C., 55° C. or 60° C.), and 50 percent RH for 24 hours. After 24 hours, the sample is removed and cooled in air for 30 minutes prior to the measurement. After cooling, the sample is transferred from the weighing pan to the above 1,000 $\mu$m sieve at the top of the sieve stack (top (A) 1,000 $\mu$m, bottom (B) 106 $\mu$m). The difference in weight is measured, which difference provides the toner weight (m) transferred to the sieve stack. The sieve stack containing the toner sample is loaded into the holder of a Hosokawa flow tester apparatus. The tester is operated for 90 seconds with a 1 millimeter amplitude vibration. Once the flow tester times out, the weight of toner remaining on each sieve is measured and the percent heat cohesion is calculated using 100*(A+B)/m. A reading of 0 to 10 percent heat cohesion is acceptable, and 0 to 5 percent is desired at a blocking temperature of from about 45° C. to about 65° C., and preferably at a blocking temperature of about 50° C. to about 60° C.

Moreover, it is a feature of the present invention to provide a toner with high gloss, such as from about 60 to about 80 Gardner gloss units.

Additionally, it is a feature of the present invention to provide a toner with substantially no vinyl offset.

Aspects of the present invention relate to a toner comprised of a branched amorphous resin or polymer, a crystalline resin or polymer, and a colorant; a toner wherein the branched amorphous resin is a polyester, a polyamide, a polyimide, a polystyrene-acrylate, a polystyrene-methacrylate, a polystyrene-butadiene, or a polyester-imide; a toner wherein the branched amorphous resin is an alkali sulfonated polyester, an alkali sulfonated polyamide, an alkali sulfonated polyimide, an alkali sulfonated polystyrene-acrylate, an alkali sulfonated polystyrene-methacrylate, an alkali sulfonated polystyrene-butadiene, or an alkali sulfonated polyester-imide; a toner wherein the crystalline resin is a polyester, a polyamide, a polyimide, a polyethylene, a polypropylene, a polybutylene, a polyisobutyrate, an ethylene-propylene copolymer, or an ethylene-vinyl acetate copolymer; a toner wherein the crystalline resin is a polyester, a polyamide, a polyimide, a polyolefin, a polyisobutyrate, an ethylene-propylene copolymer; a toner wherein the alkali for the polyester is sodium, lithium, potassium or cesium; a toner wherein the branched amorphous resin is a sulfonated polyester resin, the crystalline resin is a sulfonated polyester resin, and which toner further includes a wax; a toner wherein the branched amorphous resin is copoly(ethylene-terephthalate)-copoly (ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), copoly(propoxylated bisphenol-A-fumarate)-copoly (propoxylated bisphenol A-5-sulfo-isophthalate), copoly(ethoxylated bisphenol-A-fumarate)-copoly (ethoxylated bisphenol-A-5-sulfo-isophthalate), or copoly (ethoxylated bisphenol-A-maleate)copoly(ethoxylated bisphenol-A-5-sulfo-isophthalate); a toner wherein the crystalline resin is poly(ethylene-adipate), poly(propylene-adipate), poly(butylene-adipate), poly(pentylene-adipate), poly(hexylene-adipate), poly(octylene-adipate), poly (ethylene-succinate), poly(propylene-succinate), poly (butylene-succinate), poly(pentylene-succinate), poly (hexylene-succinate), poly(octylene-succinate), poly (ethylene-sebacate), poly(propylene-sebacate), poly (butylene-sebacate), poly(pentylene-sebacate), poly (hexylene-sebacate), poly(octylene-sebacate), copoly(5-sulfoisophthaloyl)-copoly(ethylene-adipate), copoly(5-sulfoisophthaloyl)-copoly(propylene-adipate), copoly(5-sulfoisophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfoisophthaloyl)-copoly(ethylene-succinate), copoly(5-sulfoisophthaloyl)-copoly(propylene-succinate), copoly(5-sulfoisophthaloyl)-copoly(butylene-succinate), copoly(5-sulfoisophthaloyl)-copoly(pentylene-succinate), copoly(5-sulfoisophthaloyl)-copoly(hexylene-succinate), copoly(5-sulfoisophthaloyl)-copoly(octylene-succinate), copoly(5-sulfo-isophthaloyl)-copoly(ethylene-sebacate), copoly(5-sulfo-isophthaloyl)-copoly(propylene-sebacate), copoly(5-sulfo-isophthaloyl)-copoly(butylenes-sebacate), copoly(5-sulfo-isophthaloyl)-copoly(pentylene-sebacate), copoly(5-sulfo-isophthaloyl)-copoly(hexylene-sebacate), copoly(5-sulfo-isophthaloyl)-copoly(octylene-sebacate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), or poly (octylene-adipate); a toner with a glass transition temperature of from about 52° C. to about 65° C.; a toner wherein the branched amorphous resin has a glass transition temperature of from about 52° C. to about 65° C.; a toner wherein the crystalline resin has a melting point of from about 60° C. to about 110° C.; a toner wherein the branched amorphous resin has a number average molecular weight of from about 5,000 to about 100,000, a weight average molecular weight of from about 8,000 to about 500,000, and dispersity of from about 2 to about 36; a toner wherein the crystalline resin has a number average molecular weight of from about 1,000 to about 50,000, a weight average molecular weight of from about 2,000 to about 200,000, and dispersity of from about 2 to about 36; a toner with a particle size diameter of from about 3 to about 12 microns; a toner with a fixing temperature of from about 90° C. to about 110° C.; a toner with a fusing latitude of from about 50° C. to about 90° C.; a toner that avoids image development document offset at a temperature of from about 60° C. to about 70° C.; a toner with substantially no vinyl offset; a toner with a projection efficiency of from about 75 to about 95 percent; a toner with a gloss of from about 10 to about 90 gloss units; a toner further including a wax; a toner wherein the wax is a polypropylene, a polyethylene, or mixtures thereof; a toner wherein the amorphous resin is copoly(ethylene-terephthalate)-copoly(ethylene-5-sulfo-isophthalate), copoly(propylene-terephthalate)-copoly(propylene-5-sulfo-isophthalate), or copoly(diethylene-terephthalate)-copoly (diethylene-5-sulfo-isophthalate), and wherein the crystalline resin is copoly(5-sulfo-isophthaloyl)-copoly(ethylene-sebacate), or copoly(5-sulfo-isophthaloyl)-copoly (propylene-sebacate); a toner wherein the branched resin is a polyamide of copoly(ethylene-terephthalamide)-copoly (ethylene-5-sulfo-isophthalamide), copoly(propylene-terephthalamide)-copoly(propylene-5-sulfo-isophthalamide), and the like, or copoly(diethylene-terephthalamide)-copoly(diethylene-5-sulfo-isophthalamide); a toner wherein the polystyrene-acrylate is copoly(p-sulfostyrene)-copoly(styrene)-copoly(methyl acrylate), copoly(p-sulfostyrene)-copoly(styrene)-copoly (ethyl acrylate), copoly(p-sulfostyrene)-copoly(styrene)-copoly(propyl acrylate), or copoly(p-sulfostyrene)-copoly (styrene)-copoly(butyl acrylate); a toner wherein the polystyrene-methacrylate is copoly(p-sulfostyrene)-copoly (styrene)-copoly(methyl methacrylate), copoly(p-sulfostyrene)-copoly(styrene)-copoly(ethyl methacrylate), copoly(p-sulfostyrene)-copoly(styrene)-copoly(propyl methacrylate), or copoly(p-sulfostyrene)-copoly(styrene)-copoly(butyl methacrylate); a toner wherein the polyester-imide is copoly(ethylene-terephthalate)-copoly(ethylene-5-sulfo-isophthalate)-copoly(ethylene-terephthalimide)-copoly(ethylene-5-sulfo-isophthalimide); a toner wherein the crystalline resin is poly(ethylene-adipate), poly (ethylene-sebacate), poly(butylene-adipate), poly(butylene-sebacate), or poly(hexylene-sebacate); a toner wherein the amorphous branched resin is present in an amount of from about 40 to about 90 percent of the toner, wherein the crystalline resin is present in an amount of from about 5 to about 40 percent of the toner, and wherein the colorant is present in an amount of from about 3 to about 15 percent of the toner; a toner wherein the amorphous branched resin displays a glass transition temperature of from about 50° C. to about 65° C.; wherein the crystalline resin displays or possesses a melting temperature of from about 50° C. to about 110° C.; a toner containing an amorphous branched resin with an average molecular weight of about 2,000 to about 300,000 grams per mole; and wherein the crystalline resin displays an average molecular weight of about 1,000 to about 50,000 grams per mole; a toner wherein the colorant is a pigment; a toner wherein the colorant is dye; a toner wherein the colorant is a pigment present in an amount of from about 4 to about 18 weight percent; a toner wherein the colorant is a pigment present in an amount of from about 3 to about 15 weight percent; a toner further containing toner additives; a toner comprised of a colorant such as a pigment, a crystalline resin such as an alkali sulfonated polyester, a branched amorphous resin such as a branched alkali sulfonated polyester resin and a wax, and which toner can be preferably prepared by chemical process as illustrated in U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797. Also of interest may be U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,910,387; 5,919,595; 5,916,725; 5,902,710; 5,863,698, 5,925,488; 5,977,210 and 5,858,601, the disclosures of which are totally incorporated herein by reference.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resin examples are polyester based, such as poly (ethylene-adipate), poly(propylene-adipate), poly(butylene-adipate), poly(pentylene-adipate), poly(hexylene-adipate), poly(octylene-adipate), poly(ethylene-succinate), poly (propylene-succinate), poly(butylene-succinate), poly (pentylene-succinate), poly(hexylene-succinate), poly (octylene-succinate), poly(ethylene-sebacate), poly (propylene-sebacate), poly(butylene-sebacate), poly (pentylene-sebacate), poly(hexylene-sebacate), poly (octylene-sebacate), alkali copoly(5-sulfoisophthaloyl)-copoly(ethylene-adipate), alkali copoly(5-sulfoisophthaloyl)-copoly(propylene-adipate), alkali copoly (5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly (octylene-adipate), alkali copoly(5-sulfo-isophthaloyl)-copoly(ethylene-adipate), alkali copoly(5-sulfo-isophthaloyl)-copoly (propylene-adipate), alkali copoly(5-sulfo-isophthaloyl)-copoly(butylene-adipate), alkali copoly (5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfoisophthaloyl)-copoly (ethylene-succinate), alkali copoly(5-sulfoisophthaloyl)-copoly(propylene-succinate), alkali copoly(5-sulfoisophthaloyl)-copoly(butylenes-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly (octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly (octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly (5-sulfo-isophthaloyl)-copoly(pentylene-adipate), alkali copoly(5-sulfo-isophthaloyl)-copoly(hexylene-adipate), poly(octylene-adipate), and wherein alkali is a metal like sodium, lithium or potassium. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinamide), and poly (propylene-sebecamide). Examples of polyimides include poly(ethylene-adipimide), poly(propylene-adipimide), poly (butylene-adipimide), poly(pentylene-adipimide), poly (hexylene-adipimide), poly(octylene-adipimide), poly (ethylene-succinimide), poly(propylene-succinimide), and poly(butylene-succinimide). The crystalline resin is, for example, present in an amount of from about 5 to about 30 percent by weight of the toner components, and preferably from about 15 to about 25 percent by weight of the toner components. The crystalline resin can possess various melting points of, for example, from about 30° C. to about 120° C., and preferably from about 50° C. to about 90° C., and, for example, a number average molecular weight ($M_n$), as measured by gel permeation chromatography (GPC) of, for example, from about 1,000 to about 50,000, and preferably from about 2,000 to about 25,000; with a weight average molecular weight ($M_w$) of the resin of, for example, from about 2,000 to about 100,000, and preferably from about 3,000 to about 80,000, as determined by Gel Permeation Chromatography using polystyrene standards. The molecular weight distribution ($M_w/M_n$) of the crystalline resin is, for example, from about 2 to about 6, and more specifically, from about 2 to about 4.

The crystalline resins can be prepared by the polycondensation process of reacting an organic diol, and an organic diacid in the presence of a polycondensation catalyst. Generally, a stochiometric equimolar ratio of organic diol and organic diacid is utilized, however, in some instances, wherein the boiling point of the organic diol is from about 180° C. to about 230° C., an excess amount of diol can be utilized and removed during the polycondensation process. The amount of catalyst utilized varies, and can be selected in an amount, for example, of from about 0.01 to about 1 mole percent of the resin. Additionally, in place of an organic diacid, an organic diester can also be selected, and where an alcohol byproduct is generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of organic diacids or diesters selected for the preparation of the crystalline resins include oxalic acid, succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassio salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid is selected in an amount of, for example, from about 40 to about 50 mole percent of the resin, and the alkali sulfo-aliphatic diacid can be selected in an amount of from about 1 to about 10 mole percent of the resin.

Examples of amorphous resins include polyester resins, branched polyester resins, polyimide resins, branched polyimide resins, poly(styrene-acrylate) resins, crosslinked, for example from about 25 percent to about 70 percent, poly (styrene-acrylate) resins, poly(styrene-methacrylate) resins, crosslinked poly(styrene-methacrylate) resins, poly(styrene-butadiene) resins, crosslinked poly(styrene-butadiene) resins, alkali sulfonated-polyester resins, branched alkali sulfonated-polyester resins, alkali sulfonated-polyimide resins, branched alkali sulfonated-polyimide resins, alkali sulfonated poly(styrene-acrylate) resins, crosslinked alkali sulfonated poly(styrene-acrylate) resins, poly(styrene-methacrylate) resins, crosslinked alkali sulfonated-poly (styrene-methacrylate) resins, alkali sulfonated-poly (styrene-butadiene) resins, and crosslinked alkali sulfonated poly(styrene-butadiene) resins. Alkali sulfonated polyester resins are preferred in embodiments, such as the metal or alkali salts of copoly(ethylene-terephthalate)-copoly (ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly (ethoxylated bisphenol-A-5-sulfo-isophthalate), and copoly (ethoxylated bisphenol-A-maleate)-copoly(ethoxylated bisphenol-A-5-sulfo-isophthalate), and wherein the alkali metal is, for example, a sodium, lithium or potassium ion.

The branched amorphous polyester resin in preferred embodiments possess, for example, a number average molecular weight ($M_n$), as measured by gel permeation chromatography (GPC), of from about 10,000 to about 500,000, and preferably from about 5,000 to about 250,000; a weight average molecular weight ($M_w$) of, for example, from about 20,000 to about 600,000, and preferably from about 7,000 to about 300,000, as determined by Gel Permeation Chromatography using polystyrene standards; and wherein the molecular weight distribution ($M_w/M_n$) is, for example, from about 1.5 to about 6, and more specifically, from about 2 to about 4. The onset glass transition temperature (Tg) of the resin as measured by a differential scanning calorimeter (DSC) in embodiments is, for example, from about 55° C. to about 70° C., and more specifically, from about 55° C. to about 67° C.

The branched amorphous polyester resins are generally prepared by the polycondensation of an organic diol, a diacid or diester, a sulfonated difunctional monomer, and a multivalent polyacid or polyol as the branching agent and a polycondensation catalyst.

Examples of diacid or diesters selected for the preparation of amorphous polyesters include dicarboxylic acids or diesters selected from the group consisting of terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and mixtures thereof. The organic diacid or diester are selected, for example, from about 45 to about 52 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis (hyroxyethyl)-bisphenol A, bis(2-hyroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and mixtures thereof. The amount of organic diol selected can vary, and more specifically, is, for example, from about 45 to about 52 mole percent of the resin.

Alkali sulfonated difunctional monomer examples, wherein the alkali is lithium, sodium, or potassium, include dimethyl-5-sulfo-isophthalate, dialkyl-5-sulfo-isophthalate-4-sulfo-1,8-naphthalic anhydride, 4-sulfo-phthalic acid, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, dialkyl-sulfo-terephthalate, sulfo-ethanediol, 2-sulfo-propanediol, 2-sulfo-butanediol, 3-sulfo-pentanediol, 2-sulfo-hexanediol, 3-sulfo-2-methylpentanediol, N,N-bis(2-hydroxyethyl)-2-aminoethane sulfonate, 2-sulfo-3,3-dimethylpentanediol, sulfo-p-hydroxybenzoic acid, mixtures thereo, and the like. Effective difunctional monomer amounts of, for example, from about 0.1 to about 2 weight percent of the resin can be selected.

Polycondensation catalyst examples for either the crystalline or amorphous polyesters include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof; and which catalysts are selected in amounts of, for example, from about 0.01 mole percent to about 5 mole percent based on the starting diacid or diester used to generate the polyester resin.

Branching agents include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole percent of the resin.

Various known suitable colorants, such as dyes, pigments, and mixtures thereof and present in the toner containing the polyester generated with the processes of the present invention in an effective amount of, for example, from about 1 to about 25 percent by weight of the toner, and preferably in an amount of from about 2 to about 12 weight percent, include carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), and Lithol Fast Scarlet L4300 (BASF).

Known suitable effective positive or negative charge enhancing additives can be selected for the toner compositions of the present invention, preferably in an amount of about 0.1 to about 10, and more preferably about 1 to about 3 percent by weight. Examples of these additives include quaternary ammonium compounds inclusive of alkyl pyridinium halides; alkyl pyridinium compounds, reference U.S. Pat. No. 4,298,672, the disclosure of which is totally incorporated hereby by reference; organic sulfate and sulfonate compositions, reference U.S. Pat. No. 4,338,390, the disclosure of which is totally incorporated hereby by reference; cetyl pyridinium tetrafluoroborates; distearyl dimethyl ammonium methyl sulfate; aluminum salts such as BONTRON E84™ or E88™ (Hodogaya Chemical); and the like.

There can also be blended with the toner compositions of the present invention other toner additives, such as external additive particles including flow aid additives, which additives are usually present on the surface thereof. Examples of these additives include metal oxides like titanium oxide, tin oxide, mixtures thereof, and the like; colloidal silicas, such as AEROSIL®, metal salts and metal salts of fatty acids inclusive of zinc stearate, aluminum oxides, cerium oxides, and mixtures thereof, which additives are generally present in an amount of from about 0.1 percent by weight to about 5 percent by weight, and more specifically, in an amount of from about 0.1 percent by weight to about 1 percent by weight. Several of the aforementioned additives are illustrated in U.S. Pat. Nos. 3,590,000; 3,800,588, and 6,214,507, the disclosures which are totally incorporated herein by reference.

The crystalline resin is generally present in the toner in an amount of from about 10 to about 40 percent by weight, and more preferably from about 15 to about 25 percent by weight. The branched amorphous resin is generally present in the toner in an amount of from about 60 to about 90 percent by weight, and more preferably from about 70 to about 85 percent by weight. The colorant is generally present in an amount of from about 2 to about 15 percent by weight, and optionally, a wax can be present in an amount of from about 4 to about 12 percent by weight, and wherein the toner components amount to 100 percent of the toner by weight.

The toner particles can be prepared by a variety of known methods. In embodiments of the present invention, the toner can be produced by a chemical process, and more specifically, an emulsion coalescence process such as disclosed in U.S. Pat. No. 6,143,457, the disclosure of which is totally incorporated herein by reference.

The resulting toner particles can possess an average volume particle diameter of about 2 to about 25, from about 3 to about 15, and from about 5 to about 7 microns.

The following Examples are being provided to further illustrate various species of the present invention, it being noted that these Examples are intended to illustrate and not limit the scope of the present invention.

EXAMPLE I

A crystalline sulfonated polyester resin derived from 5-sulfoisophthalic acid, sebacic acid and ethylene glycol was prepared as follows.

To a 1 liter Parr reactor equipped with a vacuum line and distillation apparatus were charged 285 grams of sebacic acid, 208 grams of ethylene glycol, 30.6 grams of 5-sulfoisophthalic acid and 0.4 gram of stannoic acid. The reactor was then heated to 165° C. with stirring over a 1 hour period, and water started to distill off; the temperature was then increased to 195° C. over a 3 hour period. The pressure was then slowly reduced from atmospheric pressure to about 260 Torr over a 1 hour period, and then reduced to 1 Torr over a 2 hour period. The reactor temperature was then increased to 210° C. over a 1 hour period, and the reactor was then purged with nitrogen to atmospheric pressure, and the polymer product discharged through the bottom drain onto a container cooled with dry ice to yield 405 grams of the resin, sodio salt of copoly(ethylene-5-sulfoisophthalate)-copoly(ethylene-sebacate). The aforementioned sulfonated polyester resin product displayed a peak melting point of 68° C. (onset) measured utilizing the 910 Differential Scanning Calorimeter available from E.I. DuPont operating at a heating rate of 10° C. per minute. The resin was then cooled with dry ice and grounded to about 5,000 mesh granules.

EXAMPLE II

A branched sulfonated amorphous polyester resin derived from dimethyl terephthalate, sodium dimethyl-5-sulfoisophthalate, 1,2-propanediol, diethylene glycol, dipropylene glycol, and trimethylolpropane was prepared as follows.

In a 1 liter Parr reactor equipped with a bottom drain valve, and distillation receiver with a cold water condenser were charged 309.5 grams of dimethylterephthalate, 38.5 grams of sodium dimethyl sulfoisophthalate, 195 grams of 1,2-propanediol (1 mole excess of glycol), 55 grams of diethylene glycol, 106 grams of dipropylene glycol, 5 grams of trimethylolpropane and 1 gram of stannoic acid. The reactor was then heated to 165° C. with stirring for 3 hours whereby methanol started to collect in the distillation receiver. The reactor mixture was then heated to 190° C. over a one hour period, after which the pressure was slowly reduced from atmospheric pressure to about 260 Torr over a one hour period, and then reduced to 5 Torr over a two hour period. The pressure was then further reduced to about 1 Torr over a 1 hour period, and the temperature was then increased to 220° C. over a 2 hour period. The reactor was then purged with nitrogen to atmospheric pressure, and the polymer product was discharged through the bottom drain onto a container cooled with dry ice to yield 410 grams of the above branched sulfonated polyester resin. The above titled branched sulfonated polyester resin product glass transition temperature was measured to be 56.6° C. (onset) utilizing the 910 Differential Scanning Calorimeter available from E.I. DuPont operating at a heating rate of 10° C. per minute. The resin was then ground to about 500 mesh granules.

EXAMPLE III

Preparation of a Branched Sulfonated Polyester Emulsion, 12 Percent by Weight in Water A 12 percent of aqueous branched sulfonate polyester resin emulsion was prepared by first heating about 2 liters of water to about 85° C. with stirring, and adding thereto 240 grams of the branched sulfonated polyester resin of Example II, followed by continued heating at about 85° C., and stirring of the mixture for a duration of from about one to about two hours, followed by cooling to about room temperature, about 25° C. The emulsion had a characteristic blue tinge and a mean resin particle size of 65 nanometers, as measured by the Nicomp particle sizer.

EXAMPLE IV

Preparation of a Crystalline Sulfonated Polyester Emulsion

A 10 weight percent of an aqueous branched sulfonate polyester resin emulsion was prepared by first heating about 2 liters of water to about 85° C. with stirring. In a separate container was heated the crystalline sulfonated polyester resin of Example I to a temperature of about 90° C. The heated water was then homogenized at 2,000 rpm, and then added thereto were 240 grams of the molten crystalline sulfonated polyester resin of Example I from a second vessel, followed by continued heating at about 85° C., and stirring of the mixture for a duration of about 30 minutes, followed by cooling to about room temperature, about 25° C. The emulsion was comprised of about 12 percent by weight of resin in water, and a resin mean average diameter particle size of 150 nanometers, as measured by the Nicomp particle sizer.

EXAMPLE V

A 9.2 micron toner comprised of 68 percent by weight of the branched sulfonated polyester resin of Example II, 17 percent by weight of crystalline sulfonated polyester resin of Example II, 6 percent by weight of carbon black, and 9 percent by weight of Carnauba wax was prepared as follows.

340 Grams of the branched sulfonated polyester resin prepared in Example II, 85 grams of the crystalline sulfonated polyester resin of Example I, 30 grams of carbon black and 45 grams of Carnauba wax were dry blended using a tumbler for 45 minutes. The dry blend was then melt mixed together on the APV extruder, which was set at 300° F. The extrudate strand was cooled down in a water bath, and then dried and crushed into fine particles (95 percent by weight passing through 3.36 a millimeter sieve). The resulting crushed toner particles were then ground into fine toners using a jet mill (0202 Jet-O-Mizer), which toner was then classified using an A12 ACUCUT Classifier. The resulting toner product was comprised of 68 percent by weight of the branched sulfonated polyester resin of Example II, 17 percent by weight of crystalline sulfonated polyester resin of Example II, 6 percent by weight of carbon black and 9 percent by weight of Carnauba wax, and which toner displayed a volume median diameter of the toner product was 9.2 microns with 14 percent by number of fines between about 1.2 to about 4 microns.

EXAMPLE VI

A 6.5 micron cyan toner comprised of 68 percent by weight of the branched sulfonated polyester resin of Example II, 17 percent by weight of the crystalline sulfonated polyester resin of Example II, 6 percent by weight of cyan 15:3 pigment and 9 percent by weight of Carnauba wax was prepared by a chemical process as follows.

A 2 liter Buchi reactor was charged with 566 grams of the branched sulfonated polyester resin emulsion of Example III, 170 grams of the crystalline sulfonated polyester resin emulsion of Example IV, 14.3 grams of Sunsperse Cyan 15:3 aqueous dispersion (42 percent pigment), available from Sun Chemicals, and 75 grams of Carnauba wax aqueous emulsion (10 percent solids by weight), and available from Michelmann International. The mixture was heated to 80° C. with stirring at 700 revolutions per minute. To this heated mixture was then added dropwise 400 grams of an aqueous solution containing 5 percent by weight of zinc acetate. The dropwise addition of the acetate salt solution was accomplished utilizing a pump at a rate of addition at approximately 1.5 milliliters per minute. After the addition was complete (about 4.5 hours), the reaction mixture was maintained at this temperature (80° C.) for an additional 1 hour. A sample (about 2 grams) of the reaction mixture was then retrieved from the kettle, and a particle size of 5.6 microns in diameter with a GSD of 1.28 was measured by the Coulter Counter. Heating was then stopped, and the mixture left to cool to room temperature with stirring overnight, about 18 to 20 hours. The product was then discharged through the bottom drain valve, washed twice with deionized water, and freeze dried to afford 75 grams of a cyan toner comprised of 68 percent by weight of the branched sulfonated polyester resin of Example II, 17 percent by weight of the crystalline sulfonated polyester resin of Example II, 6 percent by weight of cyan 15:3 pigment and 9 percent by weight of Carnauba wax, and which toner exhibited a particle size diameter of 6.1 microns and a GSD of 1.29, as measured by the Coulter Counter.

EXAMPLE VII

A 5.5 micron cyan toner comprised of 68 percent by weight of the branched sulfonated polyester resin prepared in Example II, 17 percent by weight of the crystalline sulfonated polyester resin of Example II, 6 percent by weight of Cyan 15:3 pigment and 9 percent by weight of Carnauba wax was prepared by a chemical process as follows.

170 Grams of the branched sulfonated polyester resin prepared in Example II, and 42.5 grams of the crystalline sulfonated polyester resin of Example I were melt mixed in a Parr reactor at a temperature of 150° C. for a duration of 30 minutes. The mixture was discharged through the bottom drain valve and cooled to room temperature (about 25° C.). The resin mixture was then ground using a coffee mill, and 85 grams of this mixture were added to 700 grams of water heated at 90° C. with stirring for a one hour period. The resulting aqueous emulsion was then cooled to room temperature and additional water was added to result in a 12 aqueous emulsion of the resin mixture.

A 2 liter Buchi reactor was charged with 708 grams of the above resin emulsion mixture, 14.3 grams of Sunsperse Cyan 15:3 aqueous dispersion (42 percent pigment), available from Sun Chemicals, and 75 grams of Carnauba wax aqueous emulsion (10 percent solids by weight). The mixture was heated to 80° C. with stirring at 700 revolutions per minute. To this heated mixture were then added dropwise 400 grams of an aqueous solution containing 5 percent by weight of zinc acetate. The dropwise addition of the acetate salt solution was accomplished utilizing a pump, at a rate of addition at approximately 1.5 milliliters per minute. After the addition was complete (about 4.5 hours), the reaction mixture was maintained at this temperature for an additional 1 hour. Heating was then stopped, and the mixture left to cool to room temperature with stirring overnight. The product was then discharged through the bottom drain valve, washed twice with deionized water, and freeze dried to afford 75 grams of a cyan toner, 68 percent by weight of the branched sulfonated polyester resin of Example II, 17 percent by weight of the crystalline sulfonated polyester resin of Example II, 6 percent by weight of cyan 15:3 pigment and 9 percent by weight of Carnauba wax, and which toner possessed a particle size diameter of 5.5 microns and a GSD of 1.28, both as measured with the known Coulter Counter.

Fusing Results

All unfused images were generated using a modified Xerox Corporation copier. 1.05 Mg/cm$^2$ TMA (Toner Mass per unit Area) images on CX paper (Color Xpressions, 90 gsm, uncoated) were for gloss and crease measurements while the 1.05 mg/cm$^2$ images on FX S paper (60 gsm, uncoated) were used for hot offset tests; the above TMA corresponds to process black or three layers of toner particles (for 5.5 micron particles). The gloss/crease target was a square image placed in the center of the paper while the hot offset target was a narrow rectangle located on the leading edge of the sheet. Samples were then fused on a known Xerox Corporation fusing test fixture.

Process speed of the fuser was set to 194 millimeters/s (nip dwell of ~30 ms) and the fuser roll temperature was varied from cold offset to hot offset or up to 210° C. for gloss and crease measurements. After the set point temperature of the fuser roll has been changed, wait five minutes to allow the temperature of the belt and pressure assembly to stabilize. Fuser roll process speed was then reduced to 104 millimeters/s and the 1.05 TMA S paper samples were fused to determine the temperature where hot offset occurs. When the background (toner in areas where no image is present) of the unfused sheet is high a section of paper is attached to the trailing edge to help with the detection of hot offset.

Document offset samples were imaged onto CX paper at 0.5 mg/cm$^2$ and then directed through the fuser roll with a temperature set to ($MFT_{CA=80}$+10° C.) and fuser speed=194 millimeters/s. Toner to toner and toner to paper images were cut from the sheet, 5 centimeters by 5 centimeters, and placed under a 80 grams/cm$^2$ load at 60° C. and 50 percent RH. The document offset were tested for 24 hours. The fusing results of the above toners are summarized in Table 1.

TABLE 1

Fusing Results

| Sample | MFT | T Gloss 60 | Gloss @ 180° C. | Peak Gloss | Document Offset (24 hours) | Center Hot Offset S Paper | Fusing Latitude |
|---|---|---|---|---|---|---|---|
| Example V | 118 | 137 | 72 | 73 | 1.5 | 160<br>155* | 42<br>37* |
| Example VI | 118 | 148 | 70 | 70 | 1 | 170 | 52 |
| Example VII | 119 | 182 | 58 | 64 | 4 | >210 | 91 |

MFT: Minimum Fixing Temperature;
T Gloss 60 is the temperature at which the image gloss is 60 Gardner gloss units.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A toner comprised of a branched amorphous resin, a crystalline resin, and a colorant, and wherein said branched amorphous resin is an alkali sulfonated polyester, an alkali sulfonated polyamide, an alkali sulfonated polyimide, an alkali sulfonated polystyrene-acrylate, an alkali sulfonated polystyrene-methacrylate, an alkali sulfonated polystyrene-butadiene, or an alkali sulfonated polyester-imide, and wherein said toner is generated by an emulsion aggregation coalescence process.

2. A toner in accordance to claim 1 wherein the crystalline resin is a polyester, a polyamide, a polyimide, a polyethylene, a polypropylene, a polybutylene, a polyisobutyrate, an ethylene-propylene copolymer, or an ethylene-vinyl acetate copolymer.

3. A toner in accordance to claim 1 wherein the crystalline resin is a polyester, a polyamide, a polyimide, a polyisobutyrate, an ethylene-propylene copolymer, or an ethylene-vinyl acetate copolymer.

4. A toner in accordance with claim 1 wherein said alkali is sodium, lithium, potassium or cesium.

5. A toner in accordance with claim 1 wherein said branched amorphous resin is a sulfonated polyester resin, said crystalline resin is a sulfonated polyester resin, and which toner further includes a wax.

6. A toner in accordance with claim 1 wherein the branched amorphous resin is copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly (diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), copoly(propoxylated bisphenol-A-fumarate)-copoly (propoxylated bisphenol A-5-sulfo-isophthalate), copoly(ethoxylated bisphenol-A-fumarate)-copoly (ethoxylated bisphenol-A-5-sulfo-isophthalate), or copoly (ethoxylated bisphenol-A-maleate)-copoly(ethoxylated bisphenol-A-5-sulfo-isophthalate).

7. A toner in accordance with claim 1 wherein the crystalline resin is poly(ethylene-adipate), poly(propylene-adipate), poly(butylene-adipate), poly(pentylene-adipate), poly(hexylene-adipate), poly(octylene-adipate), poly (ethylene-succinate), poly(propylene-succinate), poly (butylene-succinate), poly(pentylene-succinate), poly (hexylene-succinate), poly(octylene-succinate), poly (ethylene-sebacate), poly(propylene-sebacate), poly (butylene-sebacate), poly(pentylene-sebacate), poly (hexylene-sebacate), poly(octylene-sebacate), copoly(5-sulfoisophthaloyl)-copoly(ethylene-adipate), copoly(5-sulfoisophthaloyl)-copoly(propylene-adipate), copoly(5-sulfoisophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfoisophthaloyl)-copoly(ethylene-succinate), copoly(5-sulfoisophthaloyl)-copoly(propylene-succinate), copoly(5-sulfoisophthaloyl)-copoly(butylene-succinate), copoly(5-sulfoisophthaloyl)-copoly(pentylene-succinate), copoly(5-sulfoisophthaloyl)-copoly(hexylene-succinate), copoly(5-sulfoisophthaloyl)-copoly(octylene-succinate), copoly(5-sulfo-isophthaloyl)-copoly(ethylene-sebacate), copoly(5-sulfo-isophthaloyl)-copoly(propylene-sebacate), copoly(5-sulfo-isophthaloyl)-copoly(butylenes-sebacate), copoly(5-sulfo-isophthaloyl)-copoly(pentylene-sebacate), copoly(5-sulfo-isophthaloyl)-copoly(hexylene-sebacate), copoly(5-sulfo-isophthaloyl)-copoly(octylene-sebacate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), or poly (octylene-adipate).

8. A toner in accordance with claim 1 with a glass transition temperature of from about 52° C. to about 65° C.

9. A toner in accordance with claim 1 wherein the branched amorphous resin has a glass transition temperature of from about 52° C. to about 65° C.

10. A toner in accordance with claim 1 wherein the crystalline resin has a melting point of from about 60° C. to about 110° C.

11. A toner in accordance with claim 1 wherein the branched amorphous resin has a number average molecular weight of from about 5,000 to about 100,000, a weight average molecular weight of from about 8,000 to about 500,000, and dispersity of from about 2 to about 36.

12. A toner in accordance with claim 1 wherein the crystalline resin has a number average molecular weight of from about 1,000 to about 50,000, a weight average molecular weight of from about 2,000 to about 200,000, and dispersity of from about 2 to about 36.

13. A toner in accordance with claim 1 with a particle size diameter of from about 3 to about 12 microns.

14. A toner in accordance with claim 1 with a fixing temperature of from about 90° C. to about 110° C.

15. A toner in accordance with claim 1 with a fusing latitude of from about 50° C. to about 90° C.

16. A toner in accordance with claim 1 that avoids image development document offset at a temperature of from about 60° C. to about 70° C.

17. A toner in accordance with claim 1 with substantially no vinyl offset.

18. A toner in accordance with claim 1 with a projection efficiency of from about 75 to about 95 percent.

19. A toner in accordance with claim 1 with a gloss of from about 10 to about 90 gloss units.

20. A toner in accordance with claim 1 further including a wax.

21. A toner in accordance with claim 20 wherein the wax is a polypropylene, a polyethylene, or mixtures thereof.

22. A toner in accordance with claim 20 wherein said amorphous resin is copoly(ethylene-terephthalate)-copoly (ethylene-5-sulfo-isophthalate), copoly(propylene-terephthalate)-copoly(propylene-5-sulfo-isophthalate), or copoly(diethylene-terephthalate)-copoly(diethylene-5-sulfo-isophthalate), and wherein said crystalline resin is copoly(5-sulfo-isophthaloyl)-copoly(ethylene-sebacate), or copoly(5-sulfo-isophthaloyl)-copoly(propylene-sebacate).

23. A toner in accordance with claim 1 wherein said branched resin is a polyamide of copoly(ethylene-terephthalamide)-copoly(ethylene-5-sulfo-isophthalamide), copoly(propylene-terephthalamide)-copoly(propylene-5-sulfo-isophthalamide), or copoly(diethylene-terephthalamide)-copoly(diethylene-5-sulfo-isophthalamide).

24. A toner in accordance with claim 1 wherein said polystyrene-acrylate is copoly(p-sulfostyrene)-copoly (styrene)-copoly(methyl acrylate), copoly(p-sulfostyrene)-copoly(styrene)-copoly(ethyl acrylate), copoly(p-sulfostyrene)-copoly(styrene)-copoly(propyl acrylate), or copoly(p-sulfostyrene)-copoly(styrene)-copoly(butyl acrylate).

25. A toner in accordance with claim 1 wherein the polyesterimide is copoly(ethylene-terephthalate)-copoly (ethylene-5-sulfo-isophthalate)-copoly(ethylene-terephthalimide)-copoly(ethylene-5-sulfo-isophthalimide).

26. A toner in accordance with claim 1 wherein said crystalline resin is poly(ethylene-adipate), poly(ethylene-sebacate), poly(butylene-adipate), poly(butylene-sebacate), or poly(hexylene-sebacate).

27. A toner in accordance with claim 1 wherein the amorphous branched resin is present in an amount of from about 40 to about 90 percent of the toner; wherein the crystalline resin is present in an amount of from about 5 to about 40 percent of the toner; and wherein the colorant is present in an amount of from about 3 to about 15 percent of the toner.

28. A toner in accordance with claim 1 wherein the amorphous branched resin displays a glass transition temperature of from about 50° C. to about 65° C.; wherein crystalline resin displays a melting temperature of from about 50° C. to about 110° C.; wherein the amorphous branched resin displays an average molecular weight of about 2,000 to about 300,000 grams per mole; and wherein the crystalline resin displays an average molecular weight of about 1,000 to about 50,000 grams per mole.

29. A toner in accordance with claim 1 wherein the colorant is a pigment.

30. A toner in accordance with claim 1 wherein the colorant is dye.

31. A toner in accordance with claim 1 wherein the colorant is a pigment present in an amount of from about 4 to about 18 weight percent.

32. A toner in accordance with claim 1 wherein the colorant is a pigment present in an amount of from about 3 to about 15 weight percent.

33. A toner in accordance with claim 1 further containing toner additives.

34. A toner in accordance with claim 1 wherein said branched resin is copoly(ethylene-terephthalate)-copoly (ethylene-5-sulfoisophthalate).

35. A toner in accordance with claim 1 wherein said crystalline resin is the sodio salt of copoly(ethylene-5-sulfoisophthalate)-copoly(ethylene-sebacate).

36. A toner consisting essentially of a branched amorphous resin, a crystalline resin, and a colorant, and wherein the branched amorphous resin is a polyester, a polyamide, a polyimide, a polystyrene-acrylate, a polystyrene-methacrylate, a polystyrene-butadiene, or a polyester-imide; and wherein the crystalline resin is a polyester, a polyamide, a polyimide, a polyethylene, a polypropylene, a polybutylene, a polyisobutyrate, an ethylene-propylene copolymer, or an ethylene-vinyl acetate copolymer.

37. A toner in accordance with claim 36 wherein said toner is generated by an emulsion aggregation coalescence process, which process comprises the heating of an amorphous resin, a crystalline resin, and colorant, which heating comprises a first heating below the amorphous resin Tg and a second heating above the amorphous resin Tg, and wherein aggregation and coalescence of said resins and colorant are accomplished, and wherein said amorphous resin is an alkali sulfonated polyester, an alkali sulfonated polyamide, an alkali sulfonated polyimide, an alkali sulfonated polyslyrene-acrylate, an alkali sulfonated polystyrene-methacrylate, an alkali sulfonated polystyrene-butadiene, or an alkali sulfonated polyester-imide.

* * * * *